US008266722B2

(12) United States Patent
Wang

(10) Patent No.: US 8,266,722 B2
(45) Date of Patent: Sep. 18, 2012

(54) CAP BILL PLATE WITH MULTIPLE LAYERS AND CAP USING THE SAME

(76) Inventor: Tai-Kuang Wang, Taipei (TW)

( * ) Notice: Subject to any disclaimer, the term of this patent is extended or adjusted under 35 U.S.C. 154(b) by 297 days.

(21) Appl. No.: 12/813,483

(22) Filed: Jun. 10, 2010

(65) Prior Publication Data

US 2011/0302696 A1 Dec. 15, 2011

(51) Int. Cl.
*A42B 1/00* (2006.01)

(52) U.S. Cl. ..... 2/195.6; 2/195.1

(58) Field of Classification Search ..... 2/410, 10, 2/209.12, 209.13, 175.1, 175.2, 175.4, 175.6, 2/195.1, 195.5, 195.6, 195.8, 200.1, 425
See application file for complete search history.

(56) References Cited

U.S. PATENT DOCUMENTS 3,072,915 A * 1/1963 Henschel ..... 2/195.6
4,549,316 A * 10/1985 Johnson ..... 2/195.1
4,982,449 A * 1/1991 Finkelstein ..... 2/200.1
5,701,607 A * 12/1997 Kaiser ..... 2/209.13
5,729,830 A * 3/1998 Luhtala ..... 2/2.5
5,832,537 A * 11/1998 Wakefield, III ..... 2/195.1
5,946,734 A * 9/1999 Vogan ..... 2/412
6,076,192 A * 6/2000 Kronenberger ..... 2/195.6
6,081,933 A * 7/2000 Partsch, IV ..... 2/422
6,112,332 A * 9/2000 McCormick ..... 2/181
6,138,279 A * 10/2000 Gore ..... 2/175.5
6,158,055 A * 12/2000 Park ..... 2/195.1
6,272,689 B1 * 8/2001 Kronenberger ..... 2/175.1
6,311,331 B1 * 11/2001 Park ..... 2/195.1
6,634,030 B2 * 10/2003 Park ..... 2/195.6
6,735,782 B2 * 5/2004 Park ..... 2/175.5
6,766,538 B2 * 7/2004 Park ..... 2/175.4
6,990,692 B1 * 1/2006 Park ..... 2/195.6
7,168,100 B2 * 1/2007 Kronenberger ..... 2/175.4
7,225,475 B2 * 6/2007 Cho ..... 2/175.1
7,640,601 B2 * 1/2010 Lee ..... 2/209.13
2003/0041367 A1 * 3/2003 Hadden et al. ..... 2/195.5
2004/0013890 A1 * 1/2004 Kovalchuk et al. ..... 428/480
2006/0090244 A1 * 5/2006 Cho ..... 2/195.1
2008/0098502 A1 * 5/2008 Tai ..... 2/175.1

* cited by examiner

*Primary Examiner* — Alissa L Hoey

(57) ABSTRACT

The present invention relates to a cap bill plate having multiple-layers. The multiple layer of the cap bill plate includes three layers, a first layer, a second layer, and a third layer. The first layer includes a reflective layer thereby providing greater visibility. Since the second layer is totally foamed so as to reduce its weight, the cap wearer will feel better comfort. Besides, the third layer includes a moldable material which allows itself to be shaped in any desired structure.

4 Claims, 7 Drawing Sheets

CAP BILL PLATE WITH MULTIPLE LAYERS AND CAP USING THE SAME

BACKGROUND OF THE INVENTION

1. Field of the Invention

The present invention generally relates to a cap bill plate. Particularly, the present invention relates to a cap bill plate having multiple layers and a manufacture method thereof.

2. Description of the Prior Art

Baseball style caps are one of the most popular types of hat. These caps typically have a semi-spherical shell that fits over the wearer's head, and a brim or bill that extends perpendicularly from the bottom of the shell.

Cap bill plates are made of a rigid material covered with fabric. The rigid material is difficult for cap wearer to fold a desired bill shape, so that the cap bill plate made of a rigid material cannot provide efficient sun protection for wearers.

Cap bills provide some sun protection, but most bills leave certain areas of the face and neck inadequately protected. Many people wear baseball style caps with the bill pointed to their back. Worn in this manner the bill provides inadequate protection for the neck and ears.

The headgear attachments provide some ear and neck protection, but these attachments can only be worn with the bill pointing forward. Also, headgear attachment requires modifications to a standard baseball style cap before the attachment can be used.

The visor cap provides a means for extending the length of a cap bill, but requires specially constructed caps.

The complex construction of the visor cap and attachments increases their expense of manufacturing, their likelihood of malfunction and their unavailability to people of limited income.

Most cap bills are covered with fabrics that are easily soiled. Also, many cap bills are made of dark, non-reflective fabrics which are difficult to see in low light, thereby causing a safety problem.

SUMMARY OF THE INVENTION

It is an objective of the present invention to provide a cap bill plate and a cap using the same which includes multiple layers having moldable material. Since the moldable material of the cap bill plate allow itself to be shaped in any desired structure for sun protection, the cap bill plate of the present invention can provide face and neck areas adequate sun protection.

It is another objective of the present invention to provide a multiple-layers cap bill plate and a cap using the same which can be used without further modifying the cap itself. By reducing complex construction of the caps, all defects of complex caps including expense of manufacturing, likelihood of malfunction and unavailability to people of limited income can be alleviated.

It is a further objective of the present invention to provide a multiple-layers cap bill plate and a cap using the same capable of reducing total weight of the cap bill, providing better comfort for cap wearers.

It is yet another objective of the invention to provide a cap bill plate and a cap using the same which can be produced in a variety of colors based on aesthetic considerations.

It is yet another objective of the invention to provide a cap bill plate and a cap using the same which has a reflective layer thereby providing greater visibility, especially at night.

It is yet another objective of the invention to provide a cap bill plate and a cap using the same which has the user's name printed thereon, enabling the wearer to be readily identified by others.

The present invention achieves these objectives by providing a cap bill plate having multiple layers including a first layer, a second layer, and a third layer. The first layer is made of material selected from the group consisting of polypropylene, polystyrene, butadiene, phenylethylene, propenenitrile, ethylene vinyl acetate, linear low-density polyethylene, high density polyethylene and a combination thereof. The second layer is made of material selected from the group consisting of polyolefin filled toughener, high density polyethylene, ethylene vinyl acetate, butadiene, phenylethylene, propenenitrile, and a combination of polypropylene, polystyrene, butadiene, phenylethylene, propenenitrile, ethylene vinyl acetate, linear low-density polyethylene, high density polyethylene, polyolefin filled toughener. The third layer is made of material selected from the group consisting of ethylene vinyl acetate, linear low-density polyethylene, high density polyethylene, and a combination thereof.

DETAILED DESCRIPTION OF THE PREFERRED EMBODIMENT

Figure 1:
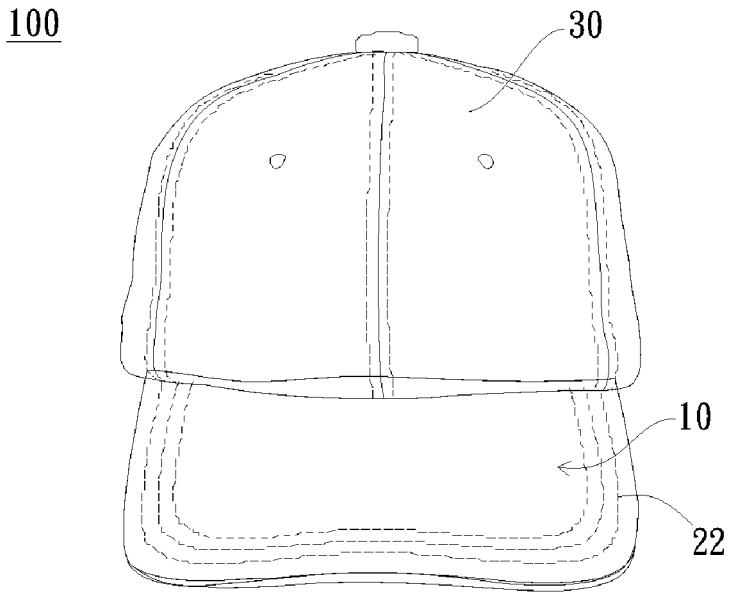
FIG. 1 shows a perspective view of one embodiment of the cap of the present invention.

In the embodiment of the present invention illustrated in FIG. 1, the cap 100 includes a cap bill 10, and a cap body 30, which is sewn with the cap bill 10. Since those seams 22 mainly locates periphery of the cap bill 10, when raining water comes in contact with the top of the cap bill, water drawn through these threads is difficult to fall onto the face of the cap wearer.

Figure 2A:
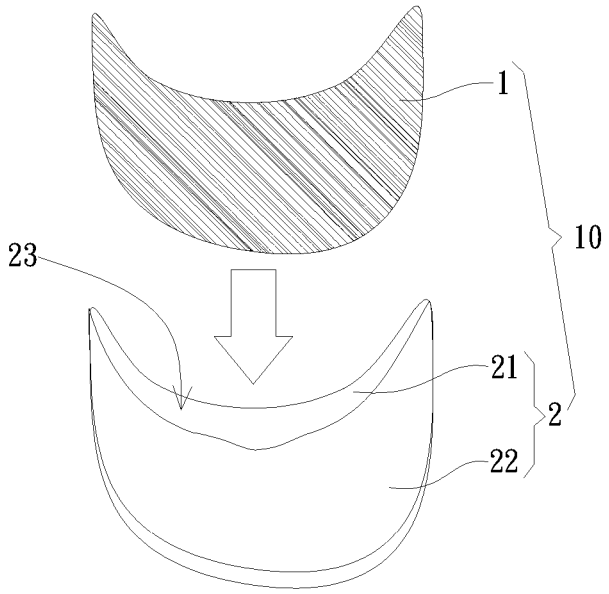
FIG. 2A shows a perspective view of one embodiment of the cap bill plate of the present invention.
Figure 2B:
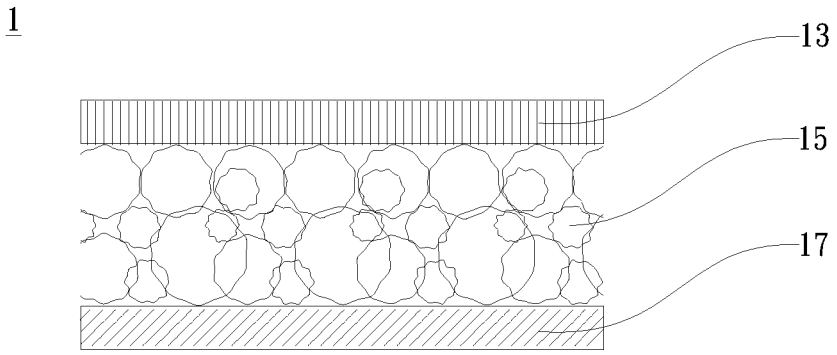
FIG. 2B shows a side view of an embodiment of the cap bill plate of the present invention.

In the embodiment shown in FIG. 2A, the cap bill 10 includes a bill cover 2 and a cap bill plate 1 having multiple layers. In the embodiment shown in FIG. 2B, a cross-section view of the cap bill plate 1 shows the raw material 11 of the cap bill plate 1 including a first layer 13, a second layer 15, and a third layer 17. These three layers includes different materials described as followings: the first layer 13 is made of material selected from the group consisting of polypropylene, polystyrene, butadiene, phenylethylene, propenenitrile, ethylene vinyl acetate, linear low-density polyethylene, high density polyethylene, and a combination thereof. Because the first layer 13 is made of the above-mentioned material, the first layer 13 is capable of providing greater visibility, especially at night. Besides, the second layer 15 is made of material selected from the group consisting of polyolefin filled toughener, high density polyethylene, ethylene vinyl acetate, butadiene, phenylethylene, propenenitrile, and a combination of polypropylene, polystyrene, butadiene, phenylethylene, propenenitrile, ethylene vinyl acetate, linear low-density polyethylene, high density polyethylene, polyolefin filled toughener. The second layer 15 of the present invention is foamed by a foaming agent which includes azodicarbonamide, zinc stearate, and ethylene bis stearamide. The foaming agent can assist the second layer 15 to be totally foamed so that the second layer 15 is lighter to reduce total weight of the cap bill 10, providing better comfort for cap wearers. Furthermore, the third layer 17 is made of material selected from the group consisting of ethylene vinyl acetate, linear low-density polyethylene, high density polyethylene, and a combination thereof. Since the third layer 17 include more moldable material as mentioned above, the third layer 17 provide a moldable property instead of rigid material of likelihood. Thus, the cap bill plate 1 having the third layer 17 allows users to fold the cap bill plate 1 or cap bill 10 in a desired structure. By such design, the cap wearers can create diverse shapes of the cap bill 10 to lead a whole new fashion.

Additionally, the foaming agent used for foaming the second layer 15 includes a weight percentage of azodicarbonamide ranging between 15% and 25% in the foaming agent, a weight percentage of zinc stearate ranging between 15% and 25% in the foaming agent, and a weight percentage of ethylene bis stearamide ranging between 25% and 35% in the foaming agent. Furthermore, in another embodiment, the foaming agent can include white paraffin oil and color masterbatch. A weight percentage of white paraffin oil ranges between 13% and 16% in the foaming agent. A weight percentage of color masterbatch ranges between 13% and 16% in the foaming agent. Particularly, the foaming agent includes 21.22% of azodicarbonamide in weight, 18.19% of zinc stearate in weight, 30.31% of ethylene bis stearamide in weight, 15.16% of white paraffin oil in weight, and 15.16% of color masterbatch in weight. Since above-mentioned particular proportion of the foaming agent is able to have a better foaming effect, the foaming agent can form a lighter second layer 15.

Figure 3A:
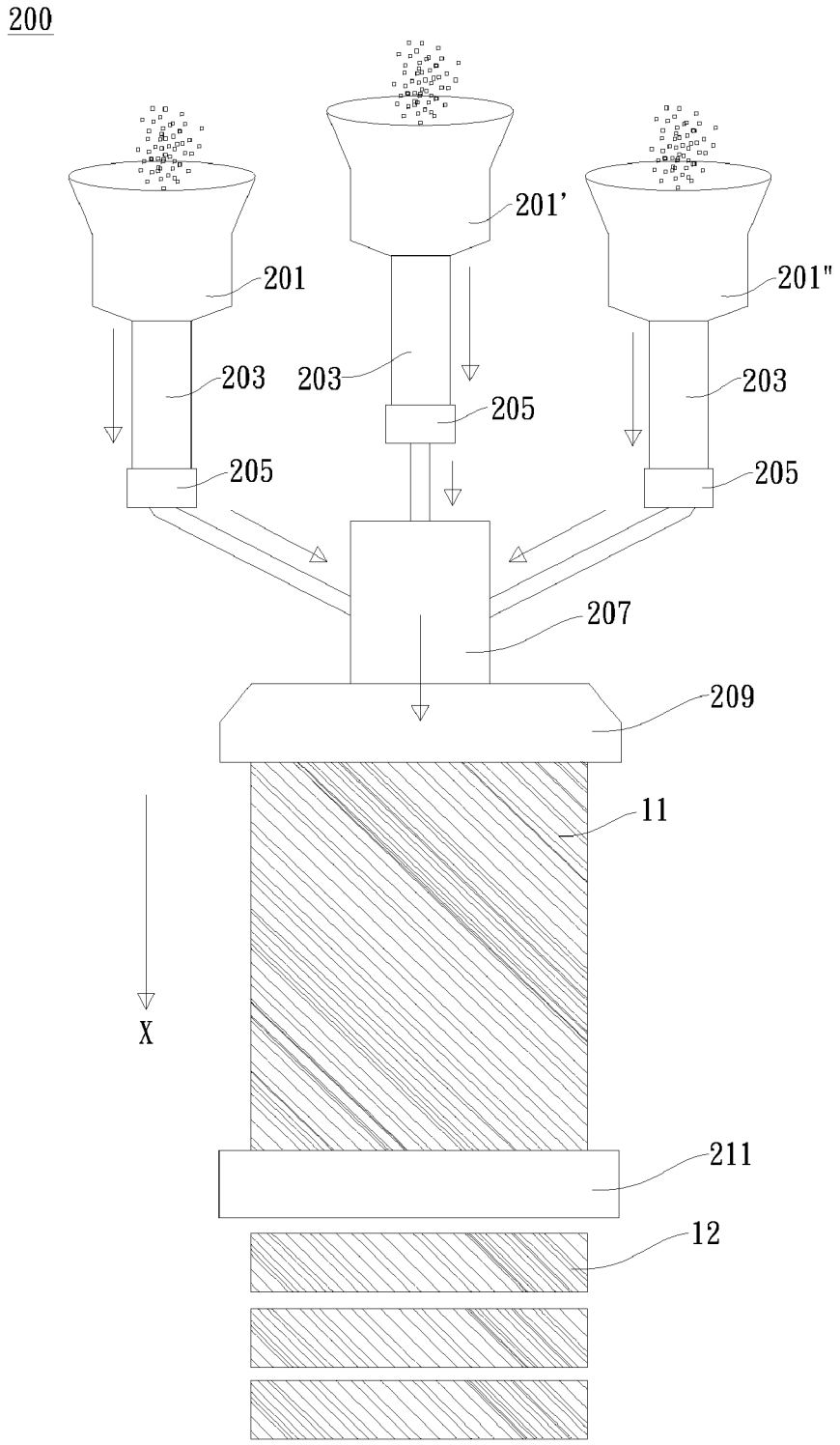
FIG. 3A shows a perspective view of an embodiment of the cap bill plate machine of the present invention.

In the embodiment shown in FIG. 3A, the bill-plate machine 200 includes at least one of feeders 201, at least one of heaters 203, at least one of filters 205, a mixer 207, a clamp cylinder 209, and a cutter 211. Each of these feeders 201, 201', 201" connecting with the respective heaters 203 can be fed with different material or same material. In this case, the feeder 201 is fed with different material. In this embodiment shown in FIG. 3A, there are three feeders including a first feeder 201, a second feeder 201', and a third feeder 201". The first feeder 201 is fed with material selected from the group consisting of polypropylene, polystyrene, butadiene, phenylethylene, propenenitrile, ethylene vinyl acetate, linear low-density polyethylene, high density polyethylene, and a combination thereof. The second feeder 201' is fed with material selected from the group consisting of polyolefin filled toughener, high density polyethylene, ethylene vinyl acetate, butadiene, phenylethylene, propenenitrile, and a combination of polypropylene, polystyrene, butadiene, phenylethylene, propenenitrile, ethylene vinyl acetate, linear low-density polyethylene, high density polyethylene, polyolefin filled toughener. The third feeder 201" is fed with material selected from the group consisting of ethylene vinyl acetate, linear low-density polyethylene, high density polyethylene, and a combination thereof.

When several materials are fed into feeders 201, 201', 201", those materials are heated by respective heaters 203. Since heaters 203 connect with filters 205, those heated materials are transported to be filtered by individual filters 205. Consequently, those filtered materials are allocated in the mixer 207, which is connected with all filters 205. The mixer 207 can respectively mix each of fed materials from each of feeders 201, 201', 201". In other words, material fed from feeder 201 won't be mixed with material fed from either feeder 201' or feeder 201". The mixer 207 directly couples with a clamp cylinder 209 and transports mixed materials to the clamp cylinder 209. After those materials are well-prepared, materials can be squeezed by the clamp cylinder 209 to form raw material 11 of the cap bill plate 1. Raw material 11 is transported along direction X and reaching a cutter 211 and cut into discrete pieces 12.

Figure 3B:
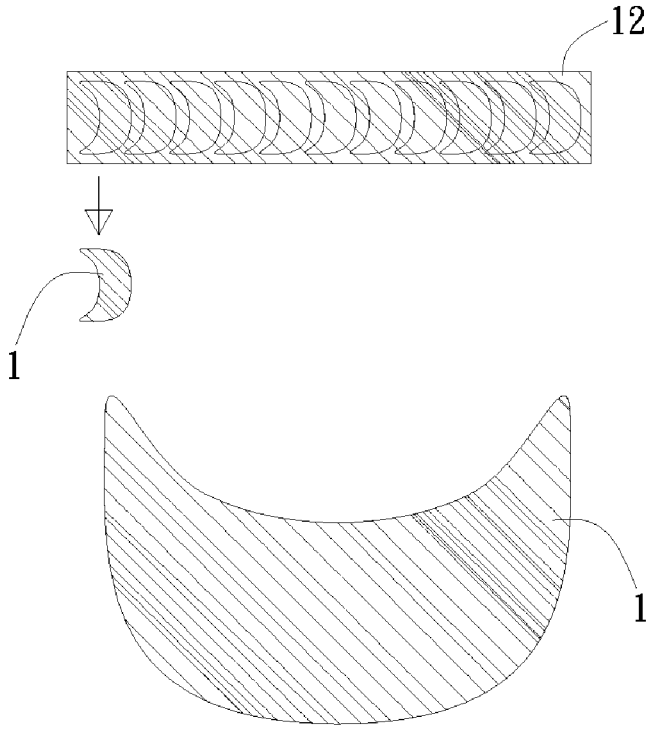
FIG. 3B shows a perspective view of an embodiment of the cap bill plate of the present invention.

In the embodiment shown in FIG. 3B, after the raw material 11 is cut as individual piece 12, the piece 12 is further cut to form several cap bill plates 1. Therefore, the cap bill plate 1 has a first layer 13, a second layer 15, and a third layer 17, as mentioned. In this embodiment, the first layer 13 includes polystyrene, butadiene, and linear low-density polyethylene. A weight percentage of polystyrene ranges between 65% and 75% in the first layer 13. A weight percentage of butadiene ranges between 15% and 25% in the first layer 13. Although a weight percentage of linear low-density polyethylene ranges between 5% and 15% in the first layer 13, the total weight percentage of polystyrene, butadiene, and linear low-density polyethylene in the first layer 13 is 100%. Besides, the second layer 15 includes ethylene vinyl acetate, high density polyethylene, polyolefin filled toughener, and butadiene. A weight percentage of ethylene vinyl acetate ranges between 20% and 30% in the second layer 15. A weight percentage of high density polyethylene ranges between 10% and 20% in the second layer 15. A weight percentage of polyolefin filled toughener ranges between 10% and 20% in the second layer 15. Although a weight percentage of butadiene ranges between 5% and 15% in the second layer 15, the total weight percentage of ethylene vinyl acetate, high density polyethylene, polyolefin filled toughener, and butadiene in the second layer 15 is 100%. Furthermore, the third layer 17 includes ethylene vinyl acetate, high density polyethylene, and linear low-density polyethylene. A weight percentage of ethylene vinyl acetate ranges between 25% and 35% in the third layer 17. A weight percentage of high density polyethylene ranges between 45% and 55% in the third layer 17. Although a weight percentage of linear low-density polyethylene ranges between 15% and 25% in the third layer 17, the total weight percentage of ethylene vinyl acetate, high density polyethylene, and linear low-density polyethylene in the third layer 17 is 100%.

TABLE 1

| Layer | Compound | Percentage % |
|---|---|---|
| First Layer 13 | polystyrene | 70 |
| | butadiene | 20 |
| | linear low-density polyethylene | 10 |
| Second Layer 15 | ethylene vinyl acetate | 25 |
| | high density polyethylene | 15 |
| | polyolefin filled toughener | 15 |
| | butadiene | 10 |
| | recycle material | 35 |

TABLE 1-continued

| Layer | Compound | Percentage % |
|---|---|---|
| Third Layer 17 | high density polyethylene | 50 |
| | ethylene vinyl acetate | 30 |
| | linear low-density polyethylene | 20 |

Particularly, as table 1 shows, the first layer 13 includes 70% of polystyrene in weight, 20% of butadiene in weight, and 10% of linear low-density polyethylene in weight. The second layer 15 includes 25% of ethylene vinyl acetate in weight, 15% of high density polyethylene in weight, 15% of polyolefin filled toughener in weight, 10% of butadiene in weight, and 35% of recycle material including polypropylene, polystyrene, butadiene, phenylethylene, propenenitrile, ethylene vinyl acetate, linear low-density polyethylene, high density polyethylene, and polyolefin filled toughener in weight. The third layer 17 includes 50% of high density polyethylene in weight, 30% of ethylene vinyl acetate in weight, and 20% of linear low-density polyethylene in weight. Since the above-mentioned material in all of three layers can form a cap bill plate 1 having multiple-layers, the cap bill plate 1 can achieve all of the proposed objects.

Figure 4A:
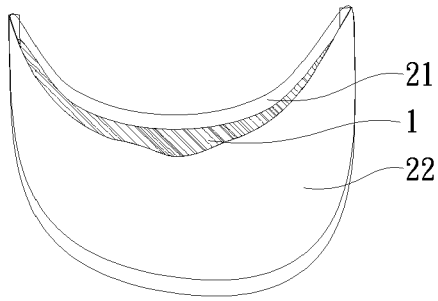
FIG. 4A shows a perspective view of one embodiment of the cap bill plate disposed into bill cover of the present invention.
Figure 4B:
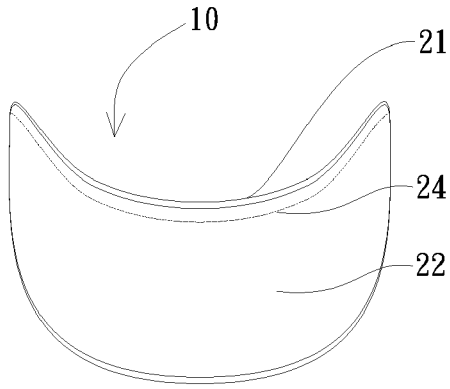
FIG. 4B shows a perspective view of one embodiment of the cap bill of the present invention.
Figure 4C:
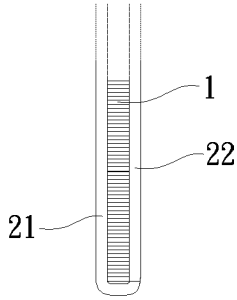
FIG. 4C shows a side view of one embodiment of the cap bill of the present invention.

In the embodiment illustrated in FIG. 2A, a cap bill 10 includes a cap bill plate 1 and a bill cover 2, which has a lower piece 21 and an upper piece 22. The cap bill plate 1 is accommodated in a bill cover 2. In this embodiment, the upper piece 22 and the lower piece 21 are substantially crescent shaped. The upper piece 22 is sewn with the lower piece 21 surrounding its periphery to form the bill cover 2 having an opening 23. After the cap bill plate 1 is disposed inside the bill cover 2 as shown in FIG. 4A, the opening is sewn surrounding its periphery as shown in FIG. 4B. As FIG. 4B is shown, the opening 23 has been sewn as a seam 24 to form a cap bill 10. In the embodiment shown in FIG. 4C, the cross-section view of the cap bill 10 shows that the cap bill 10 includes the lower piece 21, the cap bill plate 1, and the upper piece 22. However, in another embodiment shown in FIG. 4D, the cap bill 10 can only include the cap bill plate 1 and the lower piece 21. In this embodiment, the cap bill plate 1 can be produced in a variety of colors based on aesthetic considerations. Besides, the cap bill plate 1 either has the first layer 13 or is coated with a reflective layer thereon to provide greater visibility, especially at night. By such design, safety problem in dim situation can be alleviated.

Figure 4D:
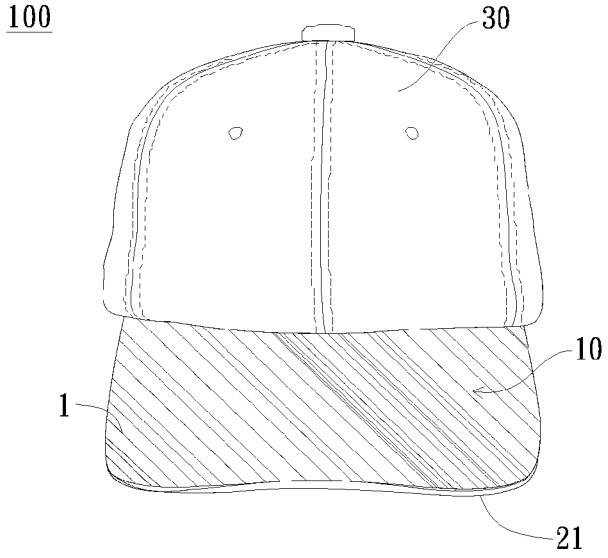
FIG. 4D shows a perspective view of one embodiment of the cap of the present invention.
Figure 4E:
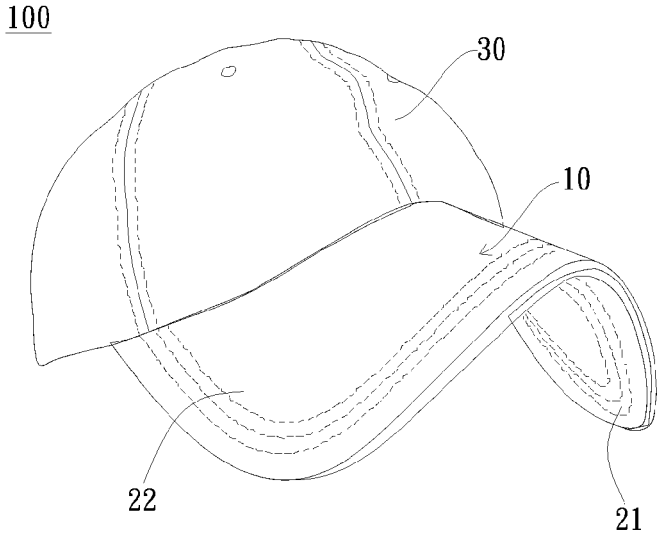
FIG. 4E shows a perspective view of one embodiment of the cap of the present invention.

Furthermore, in the embodiment shown in FIG. 4E, the user's name can be printed either on the upper piece 22 or on the cap bill plate 1 as shown in FIG. 4D that enables the wearer to be readily identified by others.

Figure 4F:
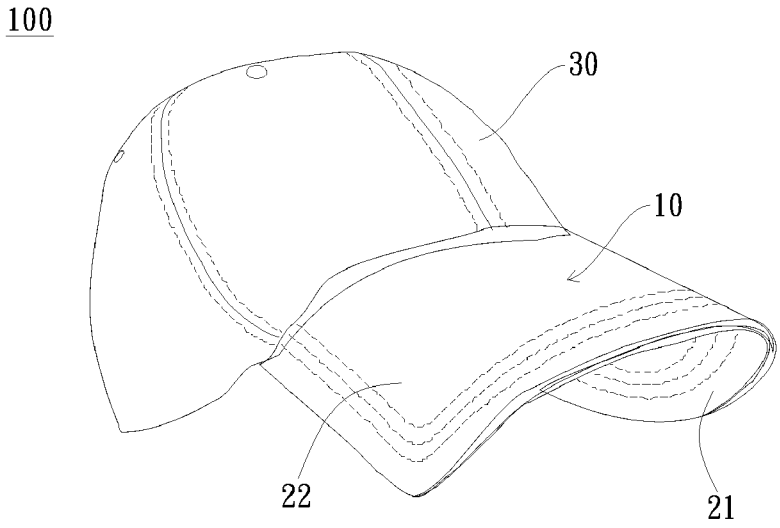
FIG. 4F shows a perspective view of another embodiment of the cap of the present invention.
Figure 4G:
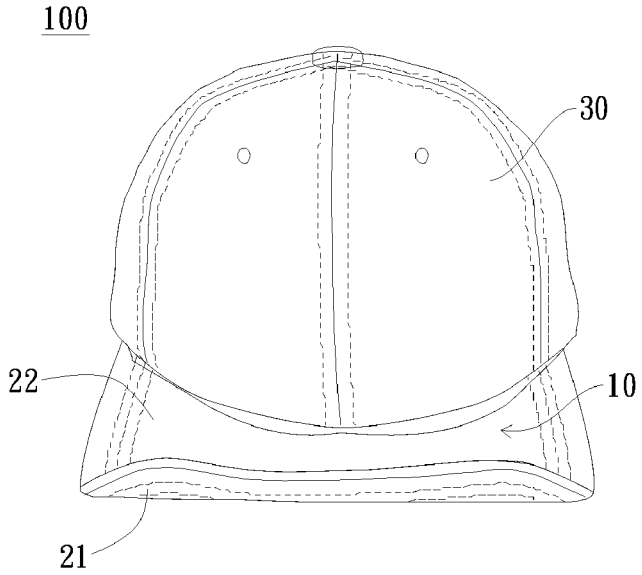
FIG. 4G shows a perspective view of another embodiment of the cap of the present invention.

In the embodiment shown in FIG. 4E, the cap 100 includes a cap bill 10 and a cap body 30, which is sewn with the cap bill 10. Those seams 22 mainly locates periphery of the cap bill 10. Since the cap bill plate 1 has multiple layers including the third layer 17, which is made of moldable material, the cap bill plate 1 allows itself to be shaped in any desired structure for adequate sun protection. In another embodiment shown in FIG. 4F, when users need better sun protection on face or neck area, they can fold the cap bill 10 to form a reverse U shape. Furthermore, in another embodiment shown in FIG. 4G, the cap bill 10 can be folded upwardly to have further protection without further modifying the cap itself, so that those defects including high expense of manufacturing, likelihood of malfunction, and unavailability to people of limited income can be alleviated.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A cap, comprising:

a cap body; and a cap bill sewn with the cap body, wherein the cap bill includes a bill cover and a cap bill plate connecting with the bill cover, the cap bill plate, including:

a first layer made of material including polystyrene, butadiene, and linear low-density polyethylene, wherein a weight percentage of polystyrene ranges between 65% and 75% in the first layer, a weight percentage of butadiene ranges between 15% and 25% in the first layer, and a weight percentage of linear low-density polyethylene ranges between 5% and 15% in the first layer, the total weight percentage is 100%;

a second layer made of material selected from the group consisting of polyolefin filled toughener, high density polyethylene, ethylene vinyl acetate, butadiene, phenylethylene, propenenitrile, and a combination of polypropylene, polystyrene, butadiene, phenylethylene, propenenitrile, ethylene vinyl acetate, linear low-density polyethylene, high density polyethylene, and polyolefin filled toughener; and a third layer made of material including ethylene vinyl acetate, linear low-density polyethylene, and high density polyethylene, wherein a weight percentage of ethylene vinyl acetate ranges between 25% and 35% in the third layer, a weight percentage of high density polyethylene ranges between 45% and 55% in the third layer, a weight percentage of linear low-density polyethylene ranges between 15% and 25% in the third layer, and the total weight percentage is 100% in the third layer; the second layer is disposed between the first layer and the third layer.

2. The cap of claim 1, wherein the second layer is foamed by adding a foaming agent including azodicarbonamide, zinc stearate, and ethylene bis stearamide, wherein a weight percentage of azodicarbonamide ranges between 15% and 25% in the foaming agent, a weight percentage of zinc stearate ranges between 15% and 25% in the foaming agent, and a weight percentage of ethylene bis stearamide ranges between 25% and 35% in the foaming agent.

3. The cap of claim 2, wherein the foaming agent further includes white paraffin oil and color masterbatch, a weight percentage of white paraffin oil ranges between 13% and 16% in the foaming agent, and a weight percentage of color masterbatch ranges between 13% and 16% in the foaming agent.

4. The cap of claim 1, wherein the second layer includes ethylene vinyl acetate, high density polyethylene, polyolefin filled toughener, and butadiene, a weight percentage of ethylene vinyl acetate ranges between 20% and 30% in the second layer, a weight percentage of high density polyethylene ranges between 10% and 20% in the second layer, a weight percentage of polyolefin filled toughener ranges between 10% and 20% in the second layer, a weight percentage of butadiene ranges between 5% and 15% in the second layer, and the total weight percentage is 100% in the second layer.

* * * * *